US006145263A

United States Patent [19]

Eckerd

[11] Patent Number: 6,145,263

[45] Date of Patent: Nov. 14, 2000

[54] LIGHT GAUGE SHEET METAL BUILDING CONSTRUCTION SYSTEM

[76] Inventor: Thomas R. Eckerd, 231 N. 4th St., Dupo, Ill. 62239

[21] Appl. No.: 09/303,780

[22] Filed: Apr. 30, 1999

Related U.S. Application Data

[60] Provisional application No. 60/083,867, May 1, 1998.

[51] Int. Cl.[7] ..... E04C 1/40

[52] U.S. Cl. ..... 52/508; 52/424; 52/425; 52/284

[58] Field of Search ..... 52/284, 730.4, 52/730.5, 730.6, 731.2, 731.3, 731.4, 424, 425, 508

*Primary Examiner*—Carl D. Friedman
*Assistant Examiner*—Patrick J. Chavez
*Attorney, Agent, or Firm*—Polster, Lieder, Woodruff & Lucchesi

[57] ABSTRACT

The present invention provides a light gauge sheet metal building construction system which has a complete exterior shell that includes all exterior walls, floors and the roof. The invention permits the pre-assembly of a sheet metal cell unit building component comprised of bent sheet metal panels connected together to form a cell unit. This component can be used for a floor system, a varying wall system, or a rigid frame roofing system for residential, commercial, or industrial building applications. It is an alternate framing system for conventional wood framed and conventional metal stud framing systems.

9 Claims, 3 Drawing Sheets

LIGHT GAUGE SHEET METAL BUILDING CONSTRUCTION SYSTEM

CROSS-REFERENCE TO RELATED APPLICATIONS

This application is based upon copending Provisional Application U.S. Serial No. 60/083,867, filed May 1, 1998.

STATEMENT REGARDING FEDERALLY SPONSORED RESEARCH OR DEVELOPMENT

Not Applicable.

BACKGROUND OF THE INVENTION

The present invention provides a light gauge sheet metal building construction system and provides for cell panels, which when assembled provides a complete building.

Historically, buildings have been constructed of many different materials. These include wood, concrete, stone, pressed board, and even sod or thatching and the like. Each of these building materials has problems when it comes to combustibility, strength, conducting of heat and cold, cost, and the like. Wood for example, permits air infiltration and is combustible. Furthermore, it has limited strength, and our continued use of wood is a drain on our natural forest resources. In addition, wood allows infestation by insects such as termites and the like.

Concrete structures are not cost effective and are difficult to construct requiring labor intensive activity. Concrete tends to crack and consequently requires reinforcing by steel or the like. Buildings of stone are very expensive and the stone tends to conduct heat and cold as well as moisture.

The present invention provides a light gauge sheet metal building construction system which has a complete exterior shell that includes all exterior walls, floors and the roof. The building construction system is very flexible and as a result meets, and in most cases, exceeds structural and thermal requirements for specific buildings.

SUMMARY OF THE INVENTION

The present invention provides a light gauge sheet metal building construction system. The system provides a complete exterior shell that includes all exterior walls, floors and the roof. The light gauge sheet metal generally has a gauge ranging from about 14 to about 28 gauge galvanized sheet metal configuration for specific structural and thermal conditions. Its design is totally flexible so as to meet and in most cases exceed these structural and thermal requirements.

The present invention comprises a sheet metal cell unit, which is preferably pre-assembled. The cell unit includes a dual cell panel. The panel comprises at least four rectangular sheet metal panels, each having a right angle bend along one side thereof to form a flange panel. The cell panel also includes a first "C" pan-shaped sheet metal panel having a side wall of a depth from about 2 to about 3 inches, a flange extending inward from the side wall from about 1 to about 2 inches and a return along an inward edge of about 0.5 inch. The cell panel also includes a second "C" pan-shaped sheet metal panel having a side wall of a depth from about 1 to about 2 inches, a flange extending inward from the side wall from about 1 to about 2 inches and a return along an inward edge of about 0.5 inch depth configured so that two sets of two of the flange panels are connected along outside surfaces of their flanges to form a first end wall and a second end wall. The first "C" pan shaped panel is connected along its side wall to a flat long side of the first end wall to form a right angle, the second end wall is connected along a flat long side to the opposite side wall of the first "C" pan shaped panel so the end walls are parallel to each other and the second "C" pan shaped panel is connected along the surfaces of its side walls to the remaining long side of each of the end walls parallel to the first "C" pan shaped panel with all of the "C" pan shaped panel flanges facing outwardly resulting in a four sided cell panel.

The most commonly used cell panel is a dual cell panel herein identified as a cell unit. The cell unit is a four sided cell panel to which has been added another first "C" pan shaped sheet metal panel attached along the outside surfaces of its side wall to the cell panel second end wall adjacent the original first "C" pan shaped sheet metal panel. Another second "C" pan shaped sheet metal panel is attached along the outside surfaces of its side walls to the cell panel second end wall adjacent the original second "C" pan shaped sheet metal panel. A third end wall connecting the other first and second "C" pan shaped sheet metal panels is connected to the other first and second "C" pan shaped sheet metal panels resulting in joined dual cell panels to form a cell unit.

In forming a one story building for example, the cell units will be attached side by side to form a wall. The cell units are approximately 8.5 feet in height representing a typical 8 foot ceiling and allowing for the inclusion of wallboard or plaster or the like to form the ceiling and still result in an 8 foot interior height. Multiple story buildings are made wherein all of the parts in the cell units generally extend in length for the entire height of the building especially when the building is not more than one or two stories high. Even if the building has more than two stories, the cell panels can extend the length of the building, but it may be necessary to provide steel support columns within the cell panels. The selection of the gauge of the sheet metal to be used, the quantity and spacing of intermediate runners, and the depth and configuration of the cell units are at least partially determined by the span distance when used as a floor application. The factors involved in determining the length of a single cell unit are:

(a) the type of application for the cell panel, i.e., floor, wall, ceiling, etc.;

(b) recommended spacing support and fastening requirements of the materials selected for internal and external use as walls, siding and flooring, etc.;

(c) floor load requirements;

(d) strength requirements; and (e) other factors which impact a building's requirements.

The preferred embodiments are one and two story buildings most probably used primarily for homes and commercial applications.

DETAILED DESCRIPTION OF THE INVENTION

Figure 1:
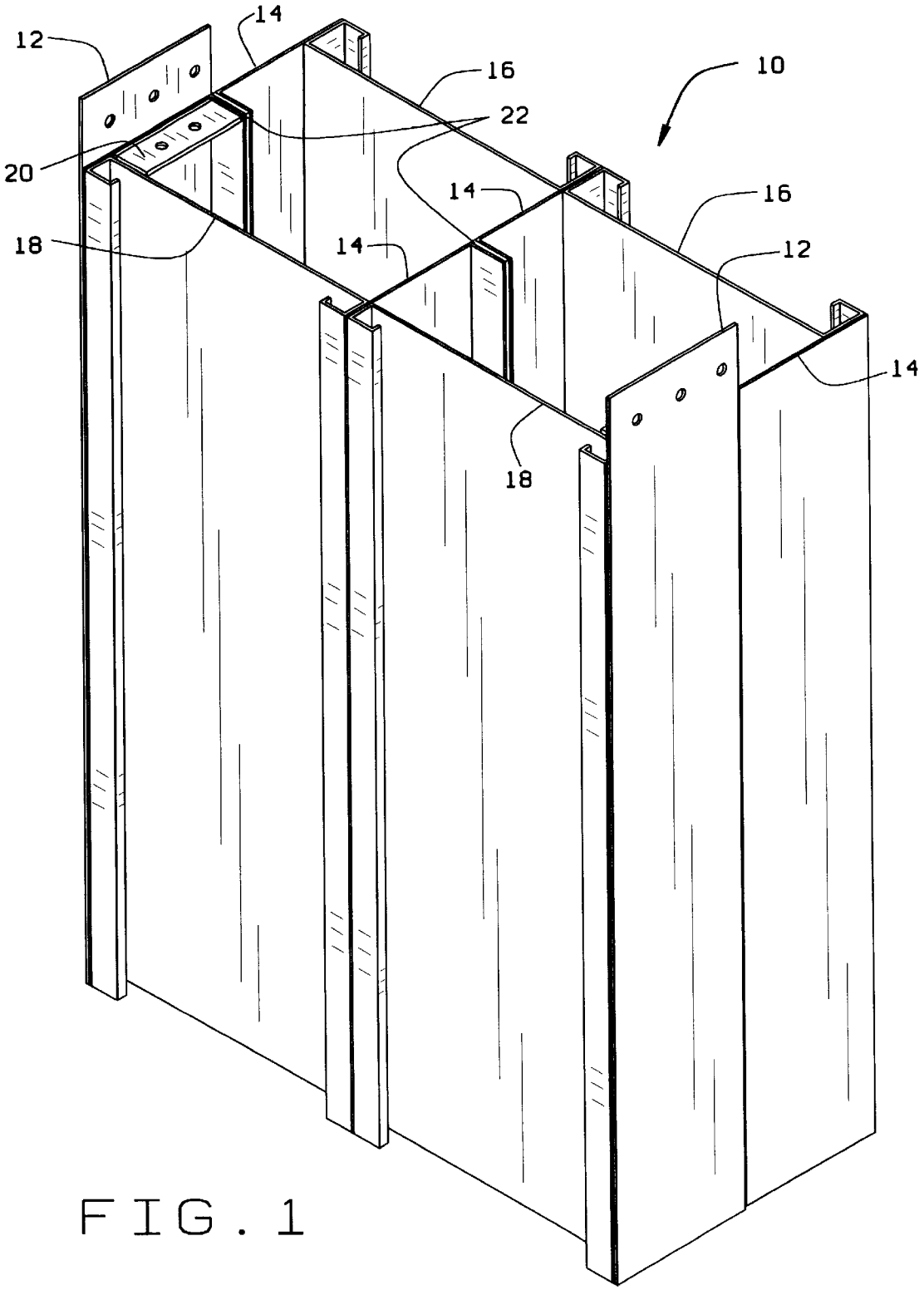
FIG. 1 is a perspective view of one embodiment of a cell unit.

FIG. 1 depicts a cell unit 10. The unit 10 contains 6 sheet metal panels 14 which have a right angle bend along one side thereof to form a flange panel. The panels 14 are joined in sets of two at the outside surfaces of the flanges. These joined panels 14 form an end wall, an intermediate wall and a far end wall. A first "C" pan shaped sheet metal panel 16 which has a side wall depth of about 2 to about 3 inches with a flange extending inward from the side wall which is about 1 to about 2 inches and a return along an inward edge of about 0.5 inch is joined to the adjacent panel 14 by means of welding or other suitable fastening means for joining sheet metal panels. Two of the panels 16 are joined to an intermediate wall formed by two panels 14. The panels 16 have the flanges extending outwardly. When forming a wall of a building, the panels 16 would extend inwardly and the flanges thereof provide the anchoring areas for wallboard plastering or the like to form internal walls. The space created between the wallboard and the base of the panels 16 created by the flanges permits space for electrical wiring, cable wiring and other utilities, which need to be provided for the interior of a building.

The cell unit 10 is further constructed of two "C" pan shaped sheet metal panels 18 which have a side wall depth from about 1 to 2 inches, a flange extending inward from the side wall about 1 to 2 inches and a return along an inward edge of the flange of about 0.5 inch depth. These panels 18 face outwardly and the flanges thereof permit attachment of exterior sheathing for a building. This sheathing may be corrugated metal, vinyl siding, pressed board, brick, stucco, stone and the like. Typically in a cell unit 10, a modified panel 14 is provided wherein an extended portion 20 is bent at a right angle to provide an attaching means for units which may be placed on top of this particular cell unit 10. Further, an additional rectangular sheet metal panel 12 is laminated to a panel 14 to provide further strength and to provide additional means for attaching one cell unit to another in a line to provide a wall.

It should be noted that where the two sheet metal panels 14 are joined along the surface of the flanges, insulation can be placed between the flanges before the panels 14 are connected. In this manner, the internal portion of a cell unit 10 consisting of panels 14 and 16 is separated by a non-conductive material from the portion of the cell unit 10 comprised of panels 14 and 18 which provide the exterior portion of the cell unit by having the insulation 22 placed in between the connecting panels 14. Neither heat nor cold is conducted from the exterior to the interior or vice versa.

Figure 2:
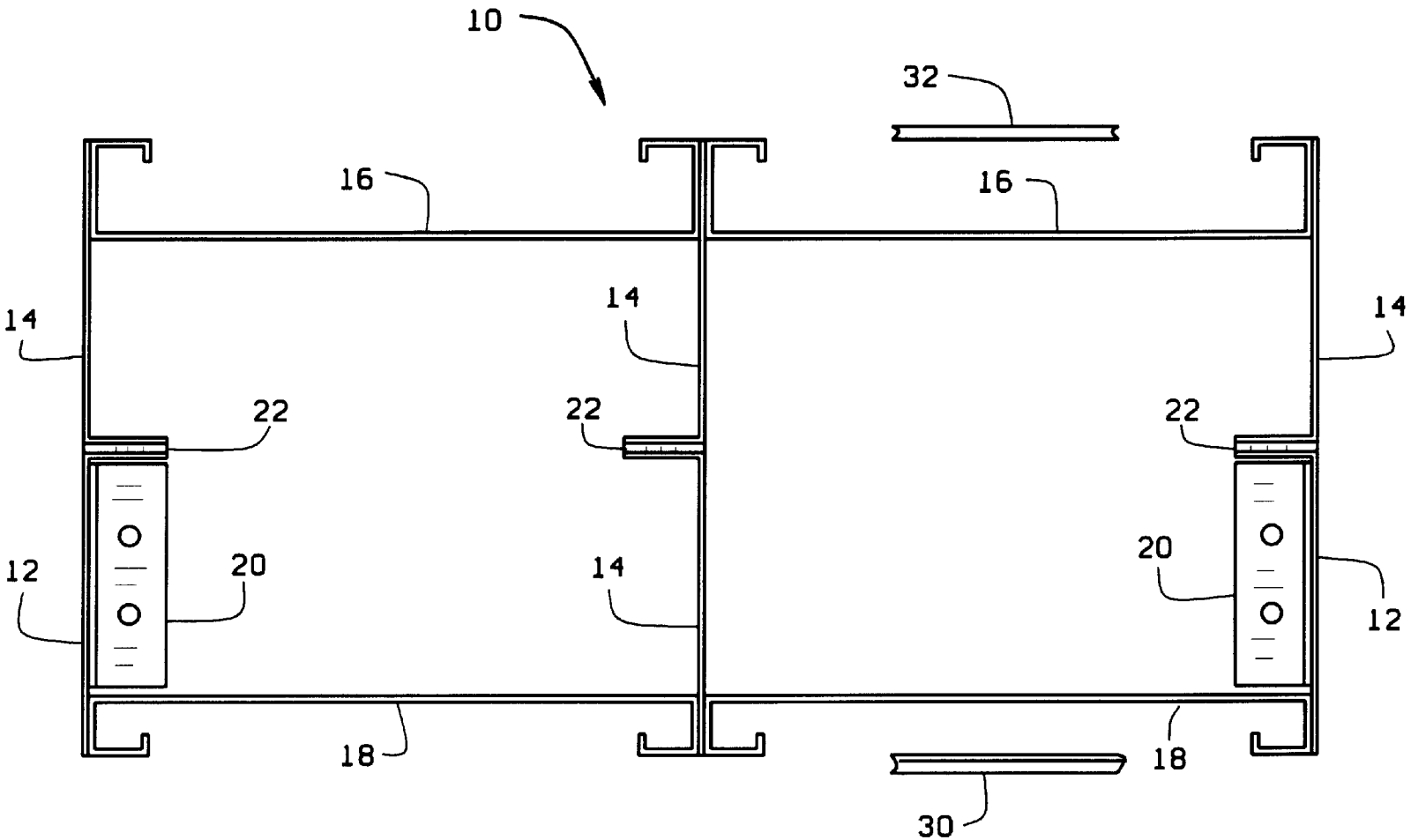
FIG. 2 is a top plan view of the cell unit of FIG. 1.

FIG. 2 is a top plan view of the cell unit 10 of FIG. 1 clearly showing the relationship of the interior portion of the panels 14 and 16 and the exterior portion of the cell unit 14 and 18 with insulation 22 placed so that heat and cold are not transferred from one section of the unit to the other. The void space in the unit can be filled with insulation creating an R factor to about 80. Such an R factor is not attainable in any other known building structure. The segment 30 depicted is exhibiting the position of an exterior sheathing showing a space between the sheathing and the base of panels 18 allowing free air flow up and down so as to prevent condensation within the cell unit. The same is true for the interior portion of the cell unit showing panels 14 and 16 with an interior sheathing 32 such as wallboard, plaster, or the like.

Figure 3:
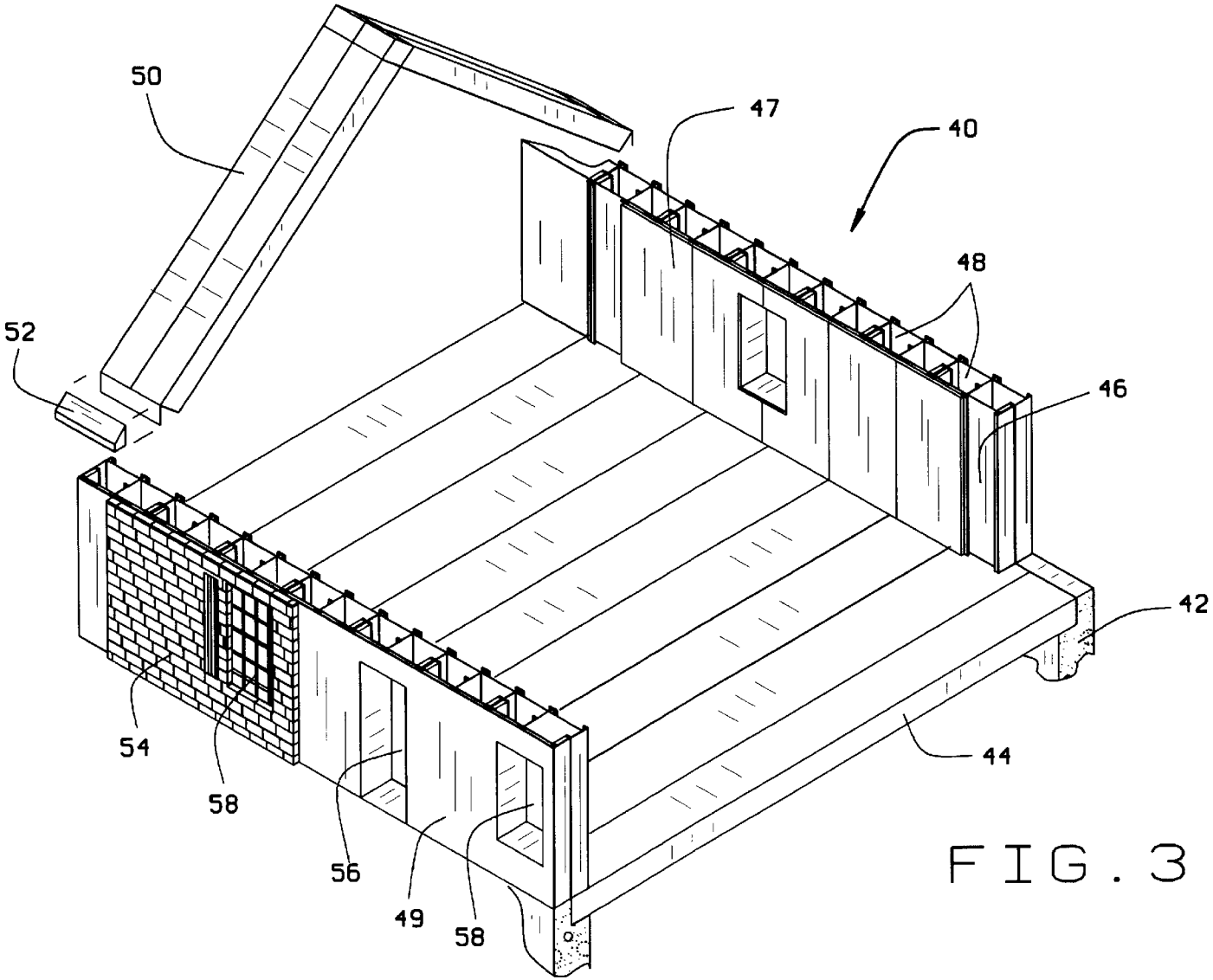
FIG. 3 is an exploded perspective view of a building.

FIG. 3 is an exploded perspective view of the building 40. The building other than the foundation 42 consists entirely of cell units 10. The floor 44 is counter set into the foundation so that the top level of the floor 44 is at the same level as the top of the foundation 42. The walls 46 rest on the foundation and floor, thus bringing the floor walls and foundation into a single unit, which is inseparable. The interior of the cell units 48 permits placement of insulation to provide a very high R factor. The exterior sheathing 49 is very easily and quickly applied to the building. This exterior sheathing may be a corrugated metal which provides additional strength to a wall or roof or floor and in addition or in substitution therefor, an exterior siding 54 such as brick, vinyl siding, aluminum siding, stucco, and the like may be used. Doorways 56 and windows 58 are easily placed by construction of window cell units off site using ordinary technology to make window openings. The interior wallboard 47 is easily placed over the wall 46 of cell units. The integrity of a series of cell units is such that wall cracks, floor cracks, and ceiling cracks are unknown.

The roof 50 may be constructed as a typical truss roof wherein corrugated metal sheathing would be used to cover the exterior of the truss or it may be of cell units 50 as depicted in this drawing. Soffits 52 are attached to provide the usual advantages to a roof structure, but are such that if high winds encounter the building 40, the soffits 52 easily separate from the roof preventing a lifting of the roof 50 from the building structure. In FIG. 3, it should be noted that the cell panels forming the roof 50 are without a ceiling bridging structure. This configuration is generally known as a cathedral ceiling. One of the advantages of the present invention is that a roof may be formed by using the standard steel trusses covered by a skin or cell panels in series with or without a bridging ceiling.

With respect to a wall or roof formed of cell units, it is very easy to add a "hat channel" upon which to hang vinyl siding or to place other roofing and siding.

Typically the panel units 16 and 18, are 12 or 16 inches wide, thus conforming to the customary standards in the building industry of having studs about 12 or 16 inches apart. In this instance, the electrical and plumbing contractors would find the same installation conditions as in a customary housing structure. The cell units are fastened one to another by conventional means such as self-drilling screws, bolts, welding or the like. The sheet metal used to form the cell units is sufficiently flexible to absorb thermal expansion thus preventing the standard types of cracks found in ceilings, walls, and floors of a conventional building. Another advantage of the building constructed using the cell units of the present invention, is that a concrete floor can simply be poured on top of the floor formed without concern about structural integrity and weight.

The cell units of the present invention permit thick walls, up to 18 inches or more thus allowing high insulation factors to be achieved. Furthermore, all of the materials are non-combustible, thus making the building, excluding added materials, fireproof. The panels 16 and 18 in the typical cell unit may be embossed or otherwise have a pattern which will improve the strength of the cell unit. Other conventional means such as the addition of corrugated sheathing, lamination of other panels, etc. also provides additional strength.

In the assembly of a typical cell unit, whether it is to be used in the wall, roof or floor, the individual components are spot-welded together at selected spacings and locations. The only exception is where the thermal break occurs as discussed with respect to FIG. 2 with panels 14 where the insulation is placed at the designation 22. The thermal material is attached by adhesives, rivets, or any other suitable fastening means. When the individual cell units are completed and taken to the building site, the units are snapped, bolted, screwed, or welded into place connecting one to another to create a wall, floor, or roof. Most generally a corrugated exterior plating is then screwed to the flanges provided, thus allowing the structure to be wrapped in a corrugated plating providing additional strength and insulation.

The gauge of the sheet metal to be used is determined by the design criteria. These are requirements of the structure such as spanning, distance, wind velocity, strength requirements, quantity of floor levels, additional foreign loads places on the structure and what the structure is to be used for.

The present invention permits the pre-assembly of a sheet metal cell unit building component. This component can be used for a floor system, a varying wall system, or a rigid frame roofing system for residential, commercial, or industrial building application. It is an alternate framing system for conventional wood framed and conventional metal stud framing systems. The cell unit system of the present invention is stronger, more energy efficient, and more environmentally friendly than conventional wood framing or conventional steel stud framing. It is formed from light gauge i.e., 14 to 28 gauge galvanized sheet metal configured for a specific structural and thermal condition. The sheet metal members are roll formed from a sheet metal coil stock and assembled to make the cell units in a factory. These cell units are shipped to the construction site and erected to form the exterior super structure, e.g., walls, floors, roofs, etc. of a building. This super structure would then be clad with the user's preferred material, for instance, bricks, stucco, siding, etc. When the cell units of the invention are used as a wall or roof, the voids in the cell units are filled with insulating material. When the cell units of the present invention are used as a floor, the units are utilized as integral ductwork. Additionally, the cell unit's configuration provides an integral electrical chase in the walls and ceilings.

In a typical erection procedure using the cell units of the present invention, the foundation of the building is put in place and the floor panels are lowered into place frequently using a small crane. The floor panels are fastened to the foundation. The upper surface of the floor is even with the top of the foundation as depicted in FIG. 3. A "C" shaped sheet metal track is installed along the exterior wall. It straddles and is fastened to the foundation and the floor panels. The wall panels are then lowered into place. They are fastened at the bottom track and to the adjacent wall panel. Metal sheathing is fastened to the exterior of walls with self-tapping sheet metal screws. The voids in the cell units in the walls are filled with insulation material. The floor panels are topped with self-leveling lightweight concrete, thus providing a completely level floor. A top cap is provided on the wall units and the pre-assembled roof is then lowered into place and fastened to the walls.

Benefits when utilizing the cell units of the present invention for building construction include non-combustibility wherein the entire structure prior to the addition of interior and exterior materials is non-combustible. The floor system uses concrete in a very simple manner. Floor spans of 28 feet or more are uninterrupted and have great strength requiring no intermediate supports; thus an open floor plan may be used. The strength of the building sustains twice the building code required to withstand wind. It is projected that a building constructed of the cell units of the present invention can withstand winds exceeding 200 mph. The wall system with its integral strength serves as a substantial barrier to flying debris in the cases of hurricanes and tornadoes. Because the building structure is made of cell units consisting of galvanized sheet metal, there is no infestation by insects and such entities as termites and the like. When the floor is finished using a thin layer of concrete, there are no squeaky floors. The entire structure is energy efficient with high insulation values upwards of R 50 factors for the walls and roof. The requirements of air conditioning and heating are easily met because of the integral branch ductwork possibilities through the cell unit structure. It is predicted that the longevity of a building structure consisting of cell units of the present invention will exceed that made from any other materials. The cell structure because of the ease within which the building is erected and utilities installed is cost effective. The size of the units required for air conditioning and heating are substantially less because of the high insulation factors and the non-transference of exterior conditions into the interior of the structure.

What is claimed is:

1. A cell panel comprising:

(a) at least four rectangular sheet metal panels each having a right angle bend along one long side thereof to form a flange panel;

(b) a first "C" pan shaped sheet metal panel having a sidewall of a depth from about two to about three inches, a flange extending inward from the sidewall from about one to about two inches and a return along an inward edge of about 0.5 inch; and (c) a second "C" pan shaped sheet metal panel having a sidewall of a depth from about one to about two inches, a flange extending inward from the sidewall from about one to about two inches and a return along an inward edge of about 0.5 inch depth, configured so that two sets of two of the flange panels are connected along outside surfaces of their flanges to form a first end wall and a second end wall, the first "C" pan shaped panel is connected along its sidewall to a flat long side of the first end wall to form a right angle, the second end wall is connected along a flat long side to the opposite sidewall of the first "C" pan shaped panel so the end walls are parallel to each other, and the second "C" pan shaped panel is connected along the surfaces of its sidewalls to the remaining long side of each of the endwalls parallel to the first "C" pan shaped panel wherein all of the "C" pan shaped panel flanges face outwardly resulting in a four sided cell panel.

2. The cell panel of claim 1 wherein the first and second "C" pan shaped panels are 16 inches wide.

3. The cell panel of claim 1 wherein the sheet metal is from about 14 to about 28 gauge sheet metal.

4. A cell unit comprising the cell panel of claim 1 to which has been added another first "C" pan shaped sheet metal panel attached along the surfaces of its sidewall to the cell panel second end wall adjacent the original first "C" pan shaped sheet metal panel, another second "C" pan shaped sheet metal panel attached along the surfaces of its sidewall to the cell panel second end wall adjacent the original second "C" pan shaped sheet metal panel, and a third end wall comprised of two flange panels connected along the surfaces of their flanges, connected to the other first and second "C" pan shaped sheet metal panels along the surfaces of their sidewalls wherein all of the "C" pan shaped panel flanges face outwardly resulting in joined dual cell panels to form a cell unit.

5. The cell unit of claim 4 wherein the first and second "C" pan shaped panels are 16 inches wide.

6. The cell unit of claim 4 wherein the sheet metal is from about 14 to about 28 gauge sheet metal.

7. A cell unit comprising:

(a) six rectangular sheet metal panels each having a right angle bend along one long side thereof to form a flange panel;

(b) two "C" pan shaped sheet metal panels having a sidewall of a depth from about two to about three inches, a flange extending inward from the sidewall from about one to about two inches and a return along an inward edge of the flange of about 0.5 inch; and (c) two "C" pan shaped sheet metal panels having a sidewall of a depth from about one to about two inches, a flange extending inward from the sidewall from about one to about two inches and a return along an inward edge of the flange of about 0.5 inch depth, configured so that three sets of two of the flange panels are connected along the outside surfaces of their flanges to form a first endwall, an intermediate wall and a second end wall, a first "C" pan shaped panel is connected along the outside surface of its sidewall to a flat long side of the first end wall to form a right angle, the intermediate wall is connected along a flat long side to the surfaces of the opposite sidewall of the first "C" pan shaped panel so the first end wall and the intermediate wall are parallel to each other; a second "C" pan shaped panel is connected along the outside surfaces of its sidewalls to the remaining long side of each of the first endwall and the intermediate wall parallel to the first "C" pan shaped panel with all of the "C" pan shaped panel flanges facing outwardly resulting in a four sided cell panel; the other first "C" pan shaped panel is connected along the outside surface of its sidewall to the cell panel intermediate wall adjacent the original first "C" pan shaped sheet metal panel, the other second "C" pan shaped panel is connected along the outside surface of its sidewall to the cell panel intermediate wall adjacent the original second "C" pan shaped sheet metal panel; and the second end wall is connected to the other first and second "C" pan shaped sheet metal panels along their respective outside surfaces of their sidewalls, wherein all of the "C" pan shaped panel flanges face outwardly resulting in joined dual cell panels to form a cell unit.

8. The cell unit of claim 7 wherein the first and second "C" pan shaped panels are 16 inches wide.

9. The cell unit of claim 7 wherein the sheet metal is from about 14 to about 28 gauge sheet metal.

* * * * *